US005545946A

United States Patent [19]

Wiemann et al.

[11] Patent Number: 5,545,946

[45] Date of Patent: Aug. 13, 1996

[54] FIELD EMISSION DISPLAY WITH GETTER IN VACUUM CHAMBER

[75] Inventors: David A. Wiemann, Mesa; Lawrence N. Dworsky, Scottsdale; James E. Jaskie, Scottsdale; Robert C. Kane, Scottsdale; Curtis D. Moyer, Phoenix, all of Ariz.

[73] Assignee: Motorola, Schaumburg, Ill.

[21] Appl. No.: 168,301

[22] Filed: Dec. 17, 1993

[51] Int. Cl.[6] ..... H01J 1/66; H01J 21/10

[52] U.S. Cl. ..... 313/497; 313/306; 313/496

[58] Field of Search ..... 313/306, 309, 313/336, 495, 496, 497

[56] References Cited

U.S. PATENT DOCUMENTS

| | | | |
|---|---|---|---|
| 3,665,241 | 5/1972 | Spindt et al. | 313/309 |
| 4,663,559 | 5/1987 | Christensen | 313/336 |
| 4,857,799 | 8/1989 | Spindt et al. | 313/309 |
| 5,138,237 | 8/1992 | Kane et al. | 313/308 |
| 5,223,766 | 6/1993 | Nakayama et al. | 313/309 |
| 5,315,206 | 5/1994 | Yoshida | 313/336 |
| 5,334,908 | 8/1994 | Zimmerman | 313/336 |
| 5,340,997 | 8/1994 | Kuo | 313/336 |
| 5,341,063 | 8/1994 | Kumar | 313/309 |

*Primary Examiner*—Michael Horabik
*Assistant Examiner*—Michael Day
*Attorney, Agent, or Firm*—Eugene A. Parsons

[57] ABSTRACT

A field emission display includes an insulating layer and an emitting layer disposed on the faceplate. A vacuum chamber is disposed between a backplane and the emitting layer and contains a getter. Apertures are defined through the insulating layer and the emitting layer for communicating contaminates from the faceplate to the vacuum chamber.

19 Claims, 3 Drawing Sheets

FIELD EMISSION DISPLAY WITH GETTER IN VACUUM CHAMBER

FIELD OF THE INVENTION

This invention relates generally to flat display devices and more particularly to flat emissive displays employing diamond material electron emitters

BACKGROUND OFF THE INVENTION

Flat displays are known in the art and may be realized by one of many techniques such as by employing, for example, liquid crystal, plasma, electroluminescent, and field emission technology. All of these known techniques suffer from a number of inherent limitations which make them unsuitable for many applications. The liquid crystal displays are non-emissive which restricts their use to environments with ambient lighting or in conjunction with an attendant light source. Plasma and electroluminescent displays, while emissive, are not readily implemented as full color displays and further suffer from insufficient light output for bright ambient applications such as in direct sunlight.

Field emission displays provide improved operation over other flat displays. However, field emission displays are known to suffer from arc discharge damage induced through liberation of adsorbed and absorbed contaminants during display operation. Also, known flat field emission displays employ spacers to maintain a nominal faceplate to electron emitter spacing. Spacers disposed between the faceplate and substrate are intrusive and objectionable as they tend to inhibit full utilization of the faceplate area.

Further, known flat field emission displays suffer from a limited capability to withstand outgassing within the evacuated volume which is an integral part of the display.

Accordingly, there exists a need for a flat field emission display which overcomes at least some of these shortcomings of the prior art.

It is one purpose of the present invention to provide a structurally sound image display apparatus which does not employ discrete supporting spacers between the electron emitting layer and the cathodoluminescent layer.

It is another purpose of the present invention to provide an image display apparatus comprised of an evacuated plenum which reduces the effects of outgassing which may occur within the display evacuated regions.

It is yet another purpose of the present invention to provide a flat image display apparatus with an electrostatic ion trap in concert with a getter material to actively control the effects of residual gas contaminants which may be disposed within the interspace aperture, the substrate aperture, and plenum.

SUMMARY OF THE INVENTION

This need and others, along with the above purposes and others, is substantially met through provision of a flat image display including a layer of energy conversion material for converting electron energy to photon energy. An electron emitter is disposed relative to the layer of energy conversion material such that an intervening region is defined between the energy conversion material and the electron emitter. An enclosing backplane is distally disposed with respect to the electron emitter and in a direction generally opposite to the energy conversion means so as to define a plenum between the backplane and the electron emitter. A getter layer is disposed in the plenum to mitigate the influence of ionic and molecular contaminants which otherwise would impinge on the electron emitter.

DETAILED DESCRIPTION OF THE DRAWINGS

Figure 1:
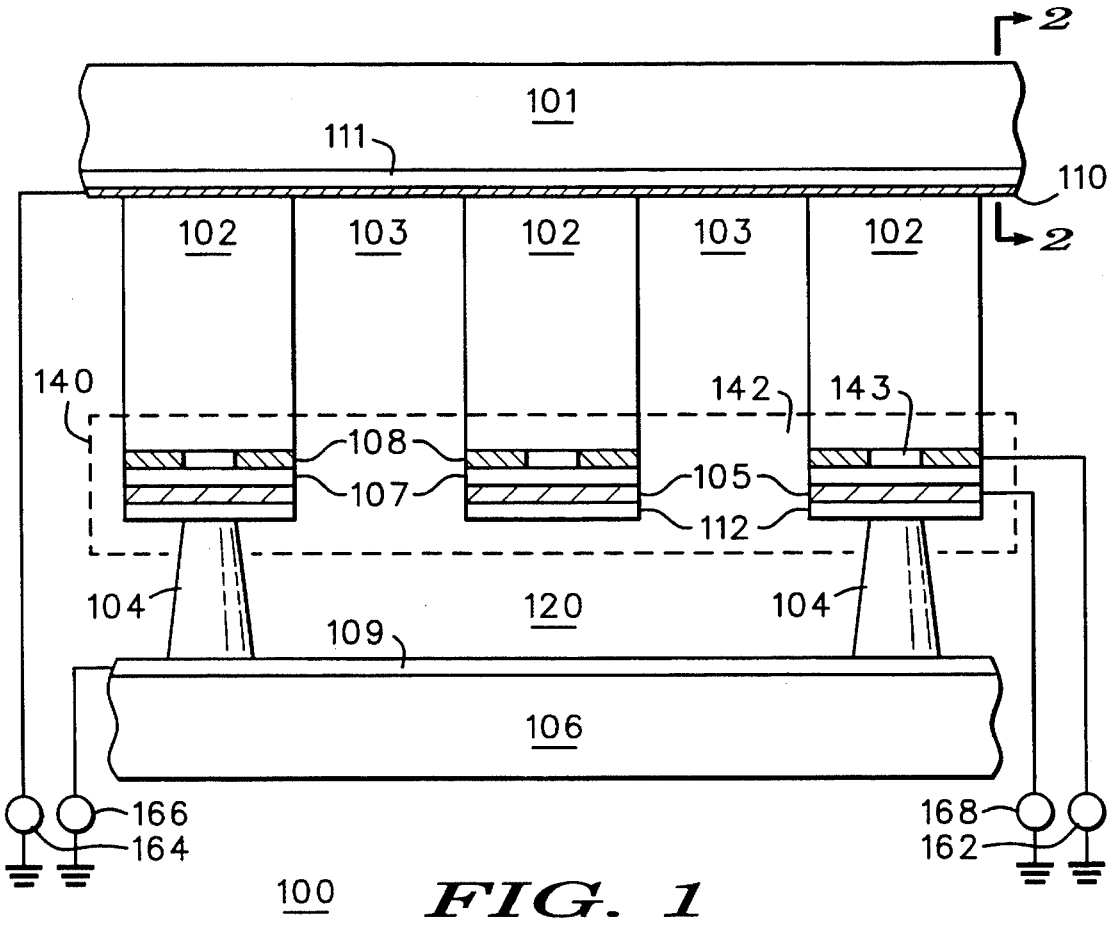
FIG. 1 is a partial side elevational schematic representation of an embodiment of a flat field emission display in accordance with the present invention.

Referring now to FIG. 1 there is depicted a partial side elevational schematic representation of an embodiment of a flat image display 100 in accordance with the present invention. A substantially optically transparent viewing screen assembly includes a transparent screen 101 having deposited thereon an energy conversion layer 111 of material such as a cathodoluminescent material layer and a conductive anode layer 110 both to be described further with respect to FIGS. 2 and 3.

An interspace insulating layer 102, having interspace apertures 103 defined therethrough and which apertures define an interspace region, is disposed in this specific embodiment on conductive anode layer 110.

A plurality of electron emitters are defined by an electron emitter substrate 140, delineated generally within a depicted dashed line box, which substrate 140 includes a non-conductive substrate 112 having disposed thereon an electron emission material layer 105 for emitting electrons, a substrate insulating layer 107 disposed on electron emissive material layer 105, a conductive gate layer 108 disposed on substrate insulating layer 107, and having substrate apertures 142 defined therethrough. Electron emissive material layer 105 may preferentially be comprised of one of, for example, diamond, diamond-like carbon, non-crystalline diamond-like carbon, aluminum nitride, and any other electron emissive material exhibiting surface work function of less than approximately 1.0 electron volts.

For the embodiment depicted in FIG. 1 conductive gate layer 108 of electron emitter substrate 140 is disposed on interspace insulating layer 102 such that substrate apertures 142 are in substantial registration with interspace apertures 103. It should also be noted that insulating spaces 143 separate portions of conductive gate layer 108, so that conductive gate layer 108 is divided into generally ring shaped portions, each of which substantially circumscribes a substrate aperture 142. For control of separate electron emitters, rows or columns of the ring shaped portions can be electrically connected.

A backplane 106 is distally disposed with respect to electron emitter substrate 140 and defines a vacuum chamber 120 therebetween. A getter material layer 109 is disposed on backplane 106 in opposition to electron emitter substrate 140. Spacers 104 are disposed substantially in vacuum chamber 120 and in operable contact with electron emitter substrate 140 and getter material layer 109 such that upon evacuation of vacuum chamber 120 the display assembly will not collapse. It should be understood that getter material layer 109 could be patterned, for example, so that spacer 104 is disposed on backplane 106, rather than getter material layer 109. For purposes of this disclosure and because getter material layer 109 is generally very thin, in either embodiment it will be considered that backplane 106 is supported by spacers 104.

Figure 2:
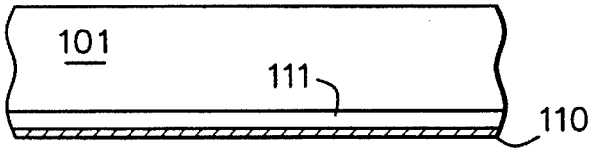
FIG. 2 is a cross-sectional schematic representation of a part of the flat field emission display as seen from the line 2—2 in FIG. 1.

A cross-sectional schematic representation of a part of the substantially optically transparent viewing assembly is illustrated in FIG. 2, including viewing screen 101, cathodoluminescent material layer 111 and conductive anode layer 110. In this embodiment cathodoluminescent material layer 111 is deposited onto faceplate 101 and conductive anode 110 is deposited onto cathodoluminescent material layer 110, in which instance conductive anode 110 may be comprised of a reflective layer to improve light transmission through faceplate 101.

Figure 3:
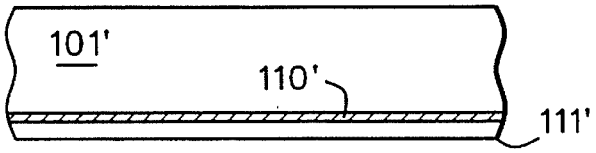
FIG. 3 is a cross-sectional schematic representation similar to FIG. 2 illustrating a different embodiment.

A cross-sectional schematic representation of another embodiment of the part of the substantially optically transparent viewing assembly is illustrated in FIG. 3. As depicted in FIG. 3 a conductive anode 110' is deposited onto a faceplate 101' in which instance the conductive anode 110' should be substantially optically transparent to facilitate the transmission of light. Cathodoluminescent material layer 111' is deposited onto conductive anode 110'.

Referring once again to FIG. 1 there are depicted a number of electrical potential sources 162, 164, 166 and 168 each operably connected to one or more elements of the image display. For the purposes of the present discussion, and by no means as a limitation of operation, each of sources 162, 164, 166 and 168 may be operably connected to a reference potential such as, for example only, ground potential. A first source 162 is operably connected between conductive gate layer 108 and the reference potential. A second source 164 is operably connected between conductive anode 110 and the reference potential. A third source 166 is operably connected between getter material layer 109 and the reference potential. A fourth source 168 is operably connected between electron emissive material layer 105 and the reference potential.

During operation of the image display apparatus, electrons emitted from electron emissive material layer 105 traverse the extent of substrate apertures 142 and interspace apertures 103 to impinge on cathodoluminescent layer 111 wherein the electrons excite photon emission. Source 162 in concert with source 168 functions to control emission of electrons. Source 164 provides an attractive potential which establishes a requisite electric field within interspace apertures 103 and provides for collection of the emitted electrons. Source 166 provides an attractive potential for ionic constituents which are randomly disposed within any of interspace apertures 103, substrate apertures 142, or vacuum chamber 120. Coincidentally, source 166 modifies emitted electron trajectories by providing an opposing potential, with respect to any negatively charged emitted electrons, at getter material layer 109.

Sources 162 and 168 are selectively applied to desired portions of an array of picture elements in a manner which provides for controlled electron emission from associated parts of electron emissive material layer 105. Such controlled electron emission provides for a desired image or plurality of images observable at faceplate 101.

Figure 4:
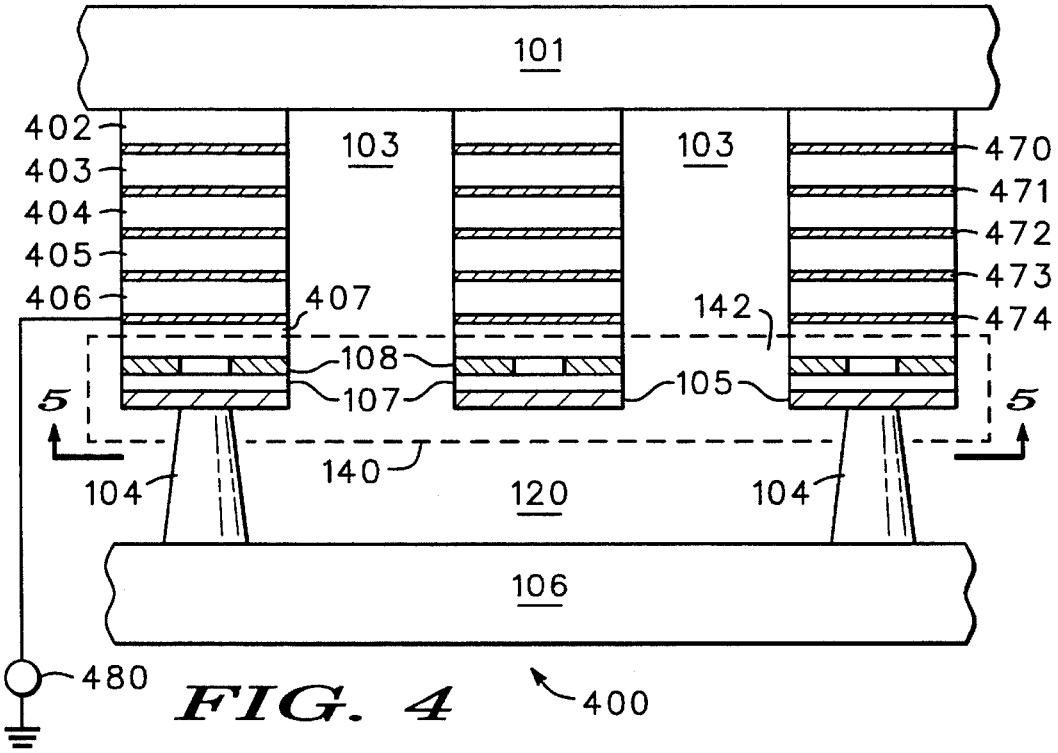
FIG. 4 is a partial side elevational schematic representation of another embodiment of a flat field emission display in accordance with the present invention

A partial side elevational schematic representation of another embodiment of a flat image display in accordance with the present invention, is illustrated in FIG. 4, wherein features previously described in FIG. 1 are similarly referenced. As further depicted in FIG. 4, interspace insulating layer 102 is comprised of a stacked plurality of insulating layers 402–407 each of which layers has associated therewith a surface on which is deposited a conductive layer 470–474 such as, for example only, molybdenum, aluminum, titanium, nickel, or tungsten. Thus, individual conductive layers 470–474 are sandwiched between adjacent insulating layers 402–407. Although the depiction of FIG. 4 includes six insulating layers with five conducting layers sandwiched therebetween, it is anticipated that fewer or more such conducting and/or insulating layers may be employed to realize interspace insulating layer 102. It is further anticipated that some or all of insulating layers 402–407 may be provided without a conductive layer disposed thereon.

Also depicted in FIG. 4 is an electrical potential source 480, such as a voltage source, operably connected between a conductive layer, in this representative example conductive layer 474, and the reference potential. Source 480 is selected to provide a desired modification to the electric field within interspace apertures 103 to affect emitted electron velocities in transit to anode 101. Other electrical potential sources, not depicted, may be similarly employed at other of conductive layers 470–473 if desired.

Figure 5:
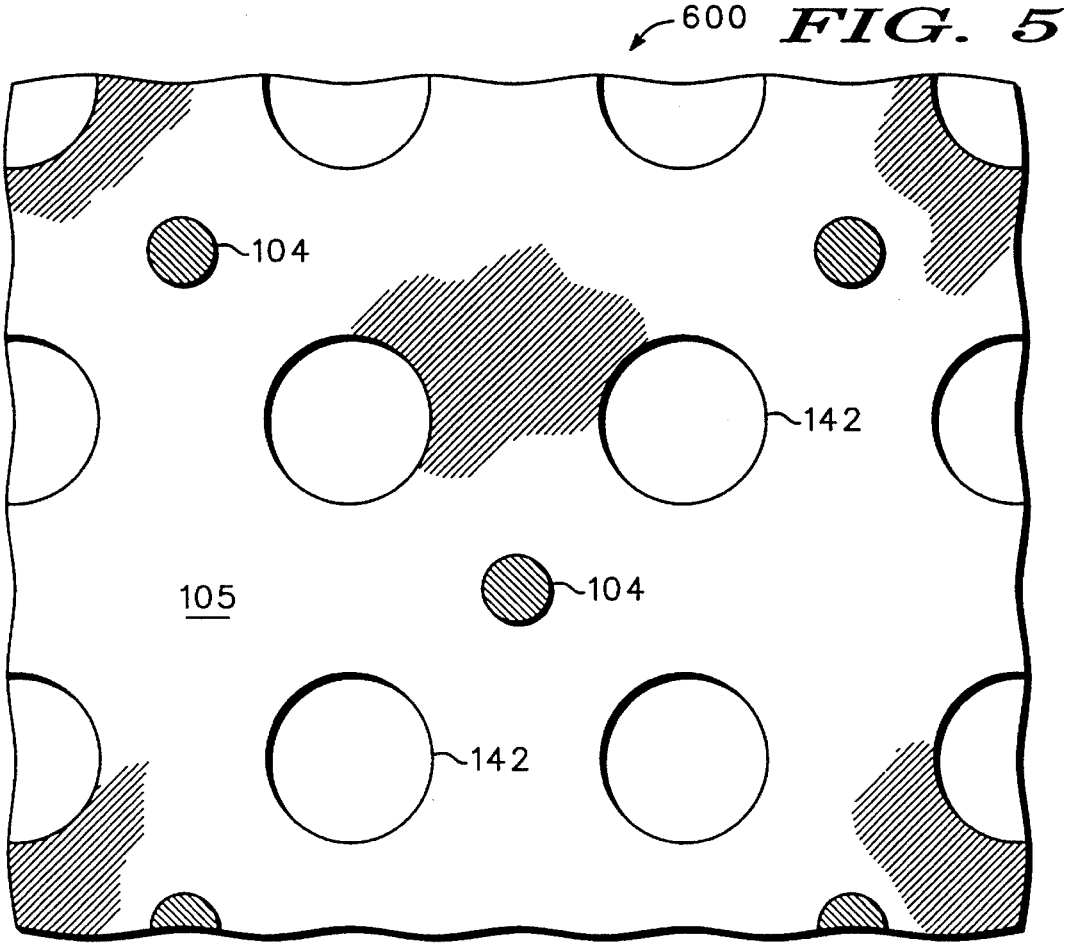
"FIG. 5 is a sectional view of the flat field emission display as seen from the line 5—5 of FIG. 4".

A sectional schematic representation, generally as seen from the line 5—5 of FIG. 4 is illustrated in FIG. 5. This view illustrates one possible embodiment of electron emitter substrate 140 having defined therethrough plurality of substrate apertures 142. FIG. 5 further depicts that electron emissive material layer 105 is selectively patterned to provide columns/rows each of which columns/rows is communicatively isolated from other columns/rows.

Figure 6:
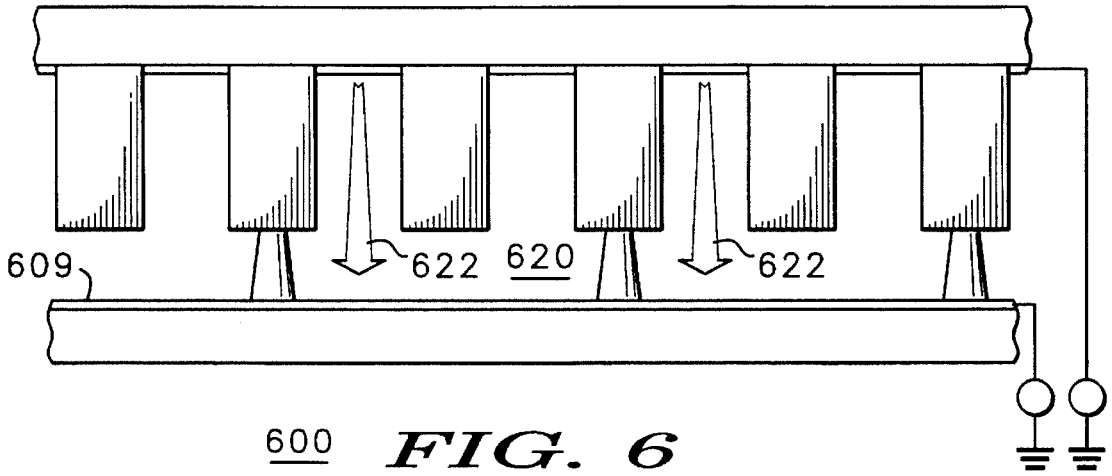
FIG. 6 is side elevational schematic representation of a flat field emission display, reduced in size and greatly simplified, in accordance with the present invention and particularly pointing out the evacuated volume and contaminate drift therein.

A simplified and reduced side elevational schematic depiction of an embodiment of an image display 600 of the present invention is illustrated in FIG. 6. In image display 600, residual and desorbed ionic and molecular contaminants 622 (herein represented as a descriptive arrow) are preferentially directed toward and collected at a getter layer 609 having traversed the extent of a vacuum chamber 620 vacuum chamber 620 provides for an increase in enclosed evacuated volume to mitigate the influence of ionic and molecular contaminants which otherwise would impinge on the electron emitters (described earlier) and result in electron emitter degradation and unacceptable image display performance.

Figure 7:
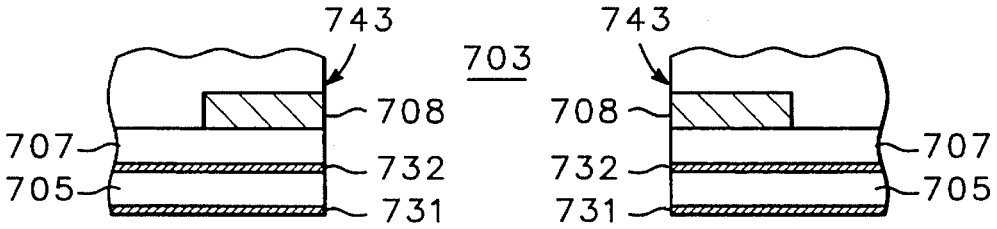
FIG. 7 is a partial side elevational schematic representation of an embodiment of a single pixel/sub-pixel of a flat field emission display in accordance with the present invention.

A partial side elevational schematic representation of another embodiment of an electron emitter substrate 740 in accordance with the present invention is illustrated in FIG. 7 and as described previously with reference to FIG. 1. In electron emitter substrate 740, a first conductive layer 732 is interposed between a substrate insulating layer 707 and an electron emissive material layer 705. Substrate insulating layer 707 has disposed on the opposite side thereof a conductive gate layer 708. A second conductive layer 731 is disposed on the the opposite side of electron emissive material layer 705, forming an interface 743, with that part of electron emissive material layer 705 associated with a substrate aperture 703 that portion of electron emissive material layer 705 which remains exposed in substrate aperture 703 provides significant electron emission.

Figure 8:
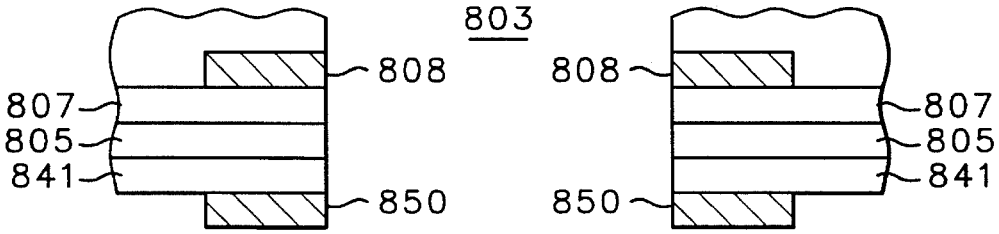
FIG. 8 is a partial side elevational schematic representation of another embodiment of a single pixel/subpixel of a flat field emission display in accordance with the present invention.

A partial side elevational schematic representation of another embodiment of an electron emitter substrate 840 is illustrated in FIG. 8 in accordance with the present invention and as described previously with reference to FIG. 1. Electron emitter substrate 840 includes an electron emission diamond material layer 805 having first and second opposed surfaces substantially parallel with respect to each other. A first substrate insulating layer 807 is disposed on one of the first and second surfaces of electron emission diamond material layer 805. A second substrate insulating layer 841 is disposed on the other of the first and second surfaces of electron emission diamond material layer 805. A first and a second conductive gate layer 808 and 850, respectively, are provided and disposed one on each of first and second substrate insulating layers 807 and 841. By providing a substantially symmetrical realization of gate layers about the periphery of electron emission diamond material layer 805 an electric field enhancement is realized over that part of electron emission diamond material layer 805 which is coincident with a substrate aperture 803.

Figure 9:
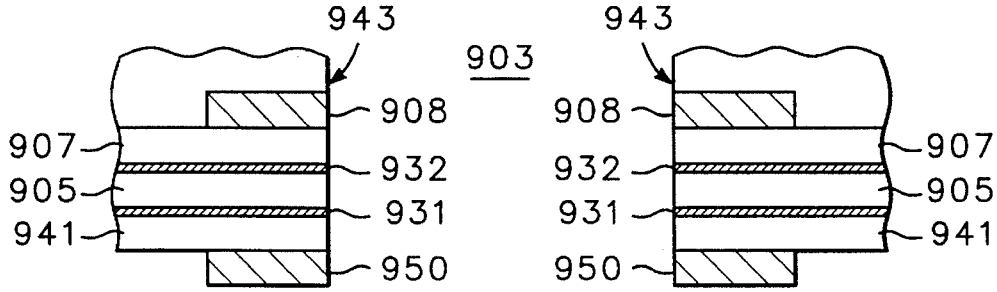
FIG. 9 is a partial side elevational schematic representation of still another embodiment of a single pixel/sub-pixel of a flat field emission display in accordance with the present invention.

A partial side elevational schematic representation of still another embodiment of an electron emitter substrate 940 in accordance with the present invention is illustrated in FIG. 9, wherein features previously described with reference to FIGS. 7 and 8 are herein similarly referenced beginning with the numeral "9". By incorporating the structural features of the electron emitter substrates of the embodiments of FIGS. 7 and 8, the embodiment depicted in FIG. 9 provides for improved electron emission at an interface 943 of layer 905 and substrate aperture 903. Further, electron emitter substrate 940 substantially inhibits any electron emission through substrate insulator layers 907 and 941, by employing first and second conductive layers 932 and 931 disposed on the first and second surfaces of electron emissive material layer 905. First and second insulating layers 907 and 941 are disposed one each on first and second conductive layers 932 and 931, respectively. A first and a second conductive gate layer 908 and 950, respectively, are provided and disposed one on each of first and second substrate insulating layers 907 and 941. For purposes of this disclosure, it should be understood that in the embodiment of FIG. 9 (and similarly in FIGS. 7 and 8) substrate insulating layers 907 and 941 are disposed in generally overlying relationship to electron emission material layer 905, even though, thin conductive layers 932 and 931 are disposed therebetween.

Thus, a structurally sound image display apparatus has been disclosed which does not employ discrete supporting spacers between the electron emitting layer and the cathodoluminescent layer. Further, an improved image display apparatus is disclosed which includes a vacuum chamber that reduces the effects of outgassing which may occur within the evacuated regions of the display. Also, a flat image display apparatus has been disclosed with an electrostatic ion trap in concert with a getter material to actively control the effects of residual gas contaminants which may be disposed within the interspace aperture, the substrate aperture, and the vacuum chamber.

What is claimed is:

1. A laminated field emission device with edge electron emitter comprising;

a substantially optically transparent faceplate assembly having a major surface and including a transparent faceplate and a layer of a cathodoluminescent material and a conductive anode positioned in overlying relationship to the faceplate;

an interspace insulating layer disposed on the major surface of the faceplate assembly and having an aperture defined therethrough which aperture further defines an interspace region;

an electron emitter substrate including an electron emission material layer for emitting electrons, a substrate insulating layer disposed in generally overlying relationship to the electron emission material layer, a conductive gate layer disposed on the substrate insulating layer, the electron emitter substrate having at least one aperture defined therethrough and the electron emitter substrate being disposed on the interspace insulating layer such that the conductive gate layer is interposed between the conductive anode and the electron emitter layer and further disposed such that the aperture defined through the electron emitter substrate is in substantial registration with the aperture defined through the interspace insulating layer; and a backplane distally disposed with respect to the electron emitter substrate, the backplane being formed to define a vacuum chamber between the backplane and the electron emitter substrate, such that upon evacuation of the vacuum chamber, the aperture defined through the electron emitter substrate and the aperture defined through the interspace insulating layer, electrons emitted by the electron emission material layer, traverse the extent of the interspace region to excite photon emission from the cathodoluminescent material.

2. A laminated field emission device with edge electron emitter as claimed in claim 1 where, in the substantially optically transparent faceplate assembly, the transparent faceplate has a major surface, the cathodoluminescent material is disposed on the major surface of the faceplate and the conductive anode is disposed on the cathodoluminescent material, and the conductive anode defines the major surface of the assembly and the interspace insulating layer is disposed on the conductive anode.

3. A laminated field emission device with edge electron emitter as claimed in claim 1 wherein the interspace layer is comprised of a plurality of layers, each of the plurality of layers having a surface, and a conductive layer is disposed on the surface of at least some of the plurality of layers.

4. A laminated field emission device with edge electron emitter as claimed in claim 1 wherein the electron emitter material layer is comprised of diamond material.

5. A laminated field emission device with edge electron emitter as claimed in claim 1 wherein the electron emitter material layer is comprised of diamond-like carbon material.

6. A laminated field emission device with edge electron emitter as claimed in claim 1 wherein the electron emitter material layer is comprised of non-crystalline diamond-like carbon material.

7. A laminated field emission device with edge electron emitter as claimed in claim 1 wherein the electron emitter material layer is comprised of aluminum nitride material.

8. A laminated field emission device with edge electron emitter as claimed in claim 1 wherein the electron emitter material layer is comprised of an electron emissive material exhibiting a surface work function of less than approximately 1.0 electron volts.

9. A laminated field emission device with edge electron emitter as claimed in claim 1 wherein the substantially optically transparent faceplate assembly includes a transparent faceplate with a major surface, a substantially optically transparent conductive anode disposed on the major surface of the transparent faceplate, cathodoluminescent material disposed on the conductive anode and the interspace insulating layer is disposed on the cathodoluminescent material.

10. A laminated field emission device with edge electron emitter as claimed in claim 9 wherein the electron emissive material layer is comprised of diamond material.

11. A laminated field emission device with edge electron emitter as claimed in claim 9 wherein the electron emissive material layer is comprised of diamond-like carbon material.

12. A laminated field emission device with edge electron emitter as claimed in claim 9 wherein the electron emissive material layer is comprised of non-crystalline diamond-like carbon material.

13. A laminated field emission device with edge electron emitter as claimed in claim 9 wherein the electron emissive material layer is comprised of aluminum nitride material.

14. A laminated field emission device with edge electron emitter as claimed in claim 9 wherein the electron emissive material layer is comprised of an electron emissive material exhibiting a surface work function of less than approximately 1.0 electron volts.

15. A laminated field emission device with edge electron emitter as claimed in claim 9 wherein the interspace layer is comprised of a plurality of layers, each of the plurality of layers having a surface, and a conductive layer is disposed on the surface of at least some of the plurality of layers.

16. A laminated field emission device with edge electron emitter as claimed in claim 1 including in addition at least one spacer disposed in the vacuum chamber so as to prevent collapsing of the vacuum chamber upon evacuation of the vacuum chamber, the aperture defined through the electron emitter substrate and the aperture defined through the interspace insulating layer.

17. A laminated field emission device with edge electron emitter as claimed in claim 1 including in addition a getter layer disposed in the vacuum chamber.

18. A laminated field emission device with edge electron emitter as claimed in claim 17 wherein the getter layer is disposed on the backplane and in opposition to the electron emitting means.

19. A laminated field emission device with edge electron emitter as claimed in claim 17 including in addition an electrical potential source operably connected between a reference potential and the getter layer such that upon evacuation any ionic constituents disposed in the intervening region are preferentially directed to the vacuum chamber.

* * * * *